US006675996B1

(12) United States Patent
Miyamoto et al.

(10) Patent No.: US 6,675,996 B1
(45) Date of Patent: Jan. 13, 2004

(54) FLOW DEVIATION PREVENTING IMMERSED NOZZLE

(75) Inventors: Hiroyuki Miyamoto, Kitakyushu (JP); Koji Kido, Kitakyushu (JP)

(73) Assignee: Krosakiharima Corporation, Fukuoka (JP)

( * ) Notice: Subject to any disclaimer, the term of this patent is extended or adjusted under 35 U.S.C. 154(b) by 40 days.

(21) Appl. No.: 10/049,325

(22) PCT Filed: Aug. 28, 2000

(86) PCT No.: PCT/JP00/05786

§ 371 (c)(1),
(2), (4) Date: Mar. 11, 2002

(87) PCT Pub. No.: WO01/15835

PCT Pub. Date: Mar. 8, 2001

(30) Foreign Application Priority Data

Aug. 27, 1999 (JP) ..... 11-242246

(51) Int. Cl.[7] ..... B22D 41/08
(52) U.S. Cl. ..... 222/594; 222/606
(58) Field of Search ..... 222/594, 600, 222/606, 607, 591

(56) References Cited

U.S. PATENT DOCUMENTS 4,730,754 A * 3/1988 Buhr et al. ..... 222/594
5,328,064 A * 7/1994 Nanba et al. ..... 222/607
6,425,505 B1 * 7/2002 Heaslip et al. ..... 222/594

FOREIGN PATENT DOCUMENTS

JP 63-2545 A * 7/1988
JP 09285854 A * 4/1997
JP 11077257 A * 3/1999
JP 11123509 A * 11/1999
JP 2000343188 A * 12/2000
JP 2002254162 A * 9/2002

* cited by examiner

*Primary Examiner*—Scott Kastler
(74) *Attorney, Agent, or Firm*—Jordan and Hamburg LLP

(57) ABSTRACT

An immersion nozzle for steel continuous casting has two delivery ports opposing each other and has one or more bore reduced portions above the delivery ports in a bore. A bore reduced portion closest to the delivery ports has an elliptical horizontal section, with an elongate direction of the ellipse nearly parallel with a direction of the delivery ports. The bore elliptic reduced portion may include another bore reduced portion second closest to the delivery port, wherein a lower end surface of the bore elliptic reduced portion closest to the delivery port can be 0.3H–2H of a delivery port height H of from an upper end of the delivery port, the spacing to the upper bore elliptic reduced portion being 0.3D–2D of a diameter D of the bore, and moreover a length of each bore reduced portion being 0.5D–5D.

5 Claims, 8 Drawing Sheets

(a)

DISTANCE BETWEEN BORE-REDUCED-PORTION LOWER END SURFACE AND DELIVERY-PORT UPPER END (b)

DISTANCE BETWEEN BORE-REDUCED-PORTION LOWER END SURFACE AND DELIVERY-PORT UPPER END (c)

(a)

(b)

(c)

PRIOR ART

FLOW DEVIATION PREVENTING IMMERSED NOZZLE

TECHNICAL FIELD

The present invention relates to an immersion nozzle to be used for pouring molten steel in continuous casting of steel.

BACKGROUND OF THE INVENTION

The immersion nozzle usually has two delivery ports formed in the left and right at around a lower end of a nozzle bore thereof. Because flow rate control is carried out by reducing the nozzle-bore area, such as in a sliding plate or upper nozzle during casting, the immersion nozzle has an inner diameter of nearly 1.1 to 3 times the reduced-bore area. Due to this, there is a tendency that the molten steel falling from the plate or upper nozzle deviates in its flow center, to cause flow deviation such that the molten-steel flow through the nozzle bore deviates to one side. As a result, there are cases that molten steel does not flow out equivalently in the left and right through the delivery ports. The deviation at the delivery ports prevents molten steel from homogeneously solidifying within a mold, resulting in an uneven structure in the solidified cast piece.

FIG. 17 is an example of a device for flow-rate control by sliding a middle plate 81 of a sliding plate device 80 comprising three plates, wherein the sliding direction is perpendicular to the delivery port 82. In this example, although the molten steel flow deviates as indicated by the arrow, it is used with the intention that, because the direction of deviated flow is in perpendicular direction to the delivery port 82, the delivery flow at the nozzle delivery port might be free from deviation. However, actually deviation occurs also in the delivery flow at the delivery port. The cause of this is considered to be that because the flow deviation caused by sliding the hole of the middle plate 81 could be twisted during falling through the nozzle bore 83, deviation would be caused in the delivery flow at the delivery port 82.

Meanwhile, Japanese Patent Laid-Open Publication No. 11-123509 describes that the provision of a step structure in an immersion-nozzle bore makes it possible to prevent the immersion nozzle from being clogged due to alumina deposition and further flow deviation in the immersion-nozzle bore from occurring thus making the in-pipe flow velocity even.

However, according to the test repeated with water model experiments by the present inventors, it has been found that a step does not completely prevent against flow deviation in the delivery flow resulting from flow deviation through the immersion-nozzle bore caused by a sliding nozzle, stopper or the like for controlling the flow rate of molten metal from the tundish to the immersion nozzle.

SUMMARY OF THE INVENTION

The present invention is, in an immersion nozzle to be used for steel continuous casting, a flow-deviation preventing immersion nozzle, shown in the following (1) to (6) descriptions, for preventing flow deviation in a delivery flow resulting from the flow deviation in the bore region.

(1) A flow-deviation preventing immersion nozzle as an immersion nozzle having opposite two delivery ports has one or more bore reduced portions at above the delivery port in a bore, wherein the bore reduced portion closest to the delivery port is an elliptic bore reduced portion having a bore form of an ellipse in horizontal section, and an elongate direction of the ellipse is nearly parallel with a direction of the delivery port.

(2) A flow-deviation preventing immersion nozzle according to (1), wherein a bore elliptic reduced portion having an ellipse having an elongate direction nearly parallel with the direction of the delivery port is provided as a bore reduced portion second closest to the delivery port.

(3) A flow-deviation preventing immersion nozzle according to (1) or (2), wherein the uppermost bore reduced portion is a bore elliptic reduced portion having an ellipse in a direction perpendicular to a slide direction of a plate.

(4) A flow-deviation preventing immersion nozzle according to (1), (2) or (3), wherein the bore in other than the bore reduced portions is nearly circular in section thereof.

(5) A flow-deviation preventing immersion nozzle according to (1), (2), (3) or (4), wherein a lower end surface of the bore elliptic reduced portion closest to the delivery port is 0.3H–2H of a delivery port height H of from an upper end of the delivery port.

(6) A flow-deviation preventing immersion nozzle according to (1), (2), (3) or (4), wherein a lower end surface of the bore elliptic reduced portion closest to the delivery port is 0.3H–2H of a delivery port height H of from an upper end of the delivery port, the spacing to the upper bore elliptic reduced portion being 0.3D–2D of a diameter D of the bore, and moreover a length of each bore reduced portion being 0.5D–5D.

BEST MODE FOR CARRYING OUT THE INVENTION

Figure 1:
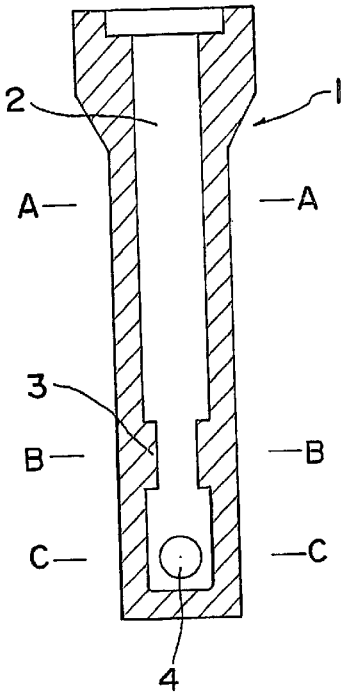
FIG. 1 is a vertical sectional view of an immersion nozzle of a first embodiment of the present invention.
Figure 2:
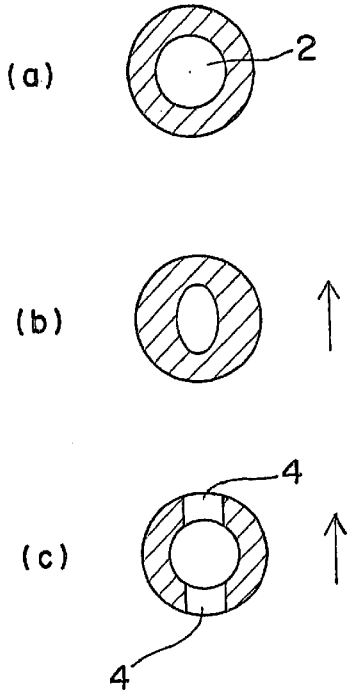
FIGS. 2 (*a*), (*b*) and (*c*) are respectively an A—A section, a B—B section and a C—C section in FIG. 1, which are horizontal sectional views of a bore, a bore reduced portion and delivery port region.

A first embodiment of the present invention is shown in FIG. 1 and FIGS. 2(*a*)–2(*c*).

FIG. 1 has a bore elliptic reduced portion 3 above a delivery port 4 in an bore 2 of an immersion nozzle 1. The inner bore of the bore elliptic reduced portion 3 is in an elliptic form in a horizontal section, as shown in FIG. 2(*b*). Also, the delivery port 4 has opposite two delivery ports 4, as shown in FIG. 2(*c*). The elongate direction of an ellipse, in a horizontal section of the bore elliptic reduced portion 3 shown by the arrow in FIG. 2, is nearly parallel with a direction of delivery ports also shown by the arrow. In FIG. 1, the portion other than the bore elliptic reduced portion 3 is nearly constant in inner diameter as shown in FIG. 2(*a*) and made straight with a circular section.

Figure 3:
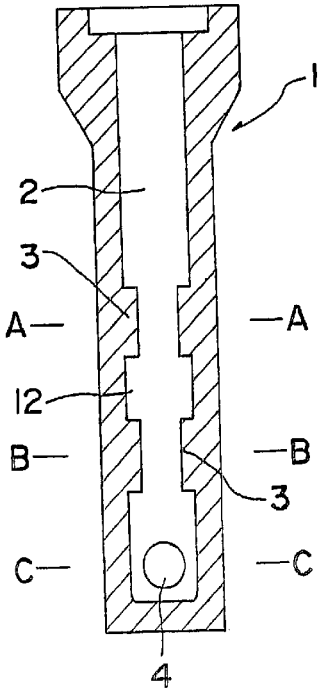
FIG. 3 is a vertical sectional view of an immersion nozzle of a second embodiment of the invention.
Figure 4:
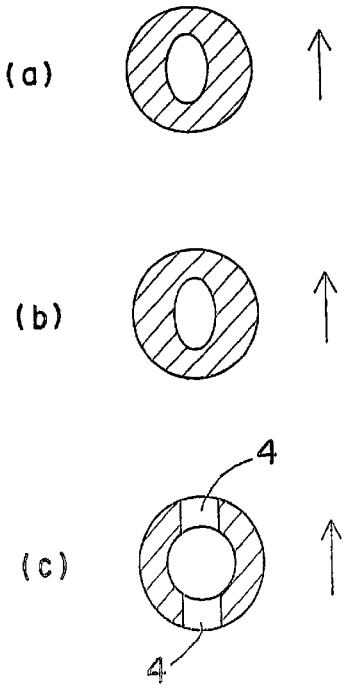
FIGS. 4 (*a*), (*b*) and (*c*) are respectively an A—A section, a B—B section and a C—C section in FIG. 3, which are horizontal sectional views of bore reduced portions and a delivery port region.

A second embodiment of the invention is shown in FIG. 3 and FIGS. 4(*a*)–4(*c*).

FIG. 3 has, above a delivery port 4 of an inner bore 2 of an immersion nozzle 1, two bore elliptic reduced portions 3, a bore-reduced portion closest to the delivery port 4 and a bore-reduced portion second closest to the delivery port 4. A bore enlarged portion 12 is provided between the two bore elliptic reduced portions 3. The bore 2 of the bore elliptic reduced portion 3 is elliptic in horizontal section, as shown in FIG. 4(*a*) and FIG. 4(*b*). Also, the delivery port 4 has opposite two delivery ports 4 as shown in FIG. 4(*c*). The elongate direction of the ellipse in horizontal section of the bore elliptic reduced portion 3 shown by the arrow in FIG. 4 is nearly parallel with a delivery ports direction shown also by the arrow. In FIG. 3, the portion other than the bore elliptic reduced portion 3 is nearly constant in inner diameter and made straight with a circular section.

In the invention, the bore area of a flow-rate control nozzle positioned above the immersion nozzle is taken as a basis, and a smaller bore area than that is referred to as a bore-reduced portion. In the case of FIG. 1, a plate brick having a bore area of 50.24 $cm^2$ is used for flow rate control, to provide a bore elliptic reduced portion with an area of 35 $cm^2$. Also, in stopper control, a basis is taken by a minimum area of a bore of an upper nozzle (tundish nozzle). In some cases, there is an immersion nozzle integrated with an upper nozzle. In this case, a basis is taken by the minimum area of a bore of a portion corresponding to the upper nozzle.

Figure 5:
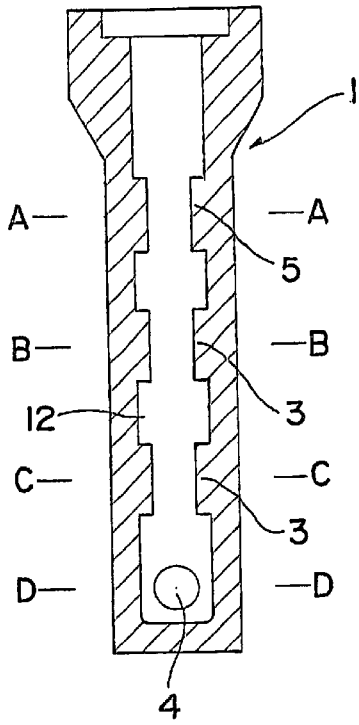
FIG. 5 is a vertical sectional view of an immersion nozzle of a third embodiment of the invention.
Figure 6:
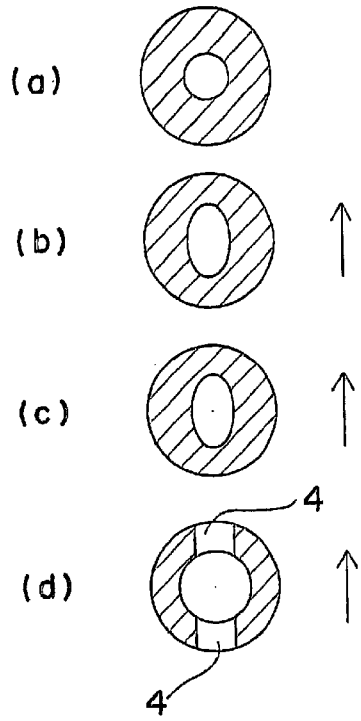
FIGS. 6 (*a*), (*b*), (*c*) and (*d*) are respectively an A—A section, a B—B section, a C—C section and a D—D section in FIG. 5, which are horizontal sectional views of bore reduced portions and a delivery port region.

A third embodiment of the invention is shown in FIG. 5 and FIGS. 6(*a*)–6(d).

The immersion nozzle of this embodiment has a total of three bore-reduced portions. The bore 2 has, above a delivery port 4, two bore elliptic reduced portions 3 that are a bore-reduced portion closest to the delivery port 4 and bore-reduced portions second closest to the delivery port.

The uppermost bore-reduced portion has a bore circular reduced portion 5 that is circular in horizontal section. The two bore elliptic reduced portions 3 have, between them, a bore enlarged portion 12 having a sectional area greater than the bore sectional area of the two bore elliptic reduced portions 3. The elongate direction of an ellipse in horizontal section of the bore-reduced portion shown by the arrow in FIG. 6 is nearly parallel with a direction of the delivery port also shown by the arrow. The immersion nozzle of this embodiment has a bore that is circular in horizontal section in a portion other than the bore-reduced portions.

In this manner, by making the bore-reduced portion closest to the delivery port 4 a bore elliptic reduced portion 3, the flow of molten steel can be rectified to improve flow deviation. Namely, by narrowing the inner diameter toward a center, the deviated center of flow is rectified toward the center. At this time, the form of the bore-reduced portion is elliptic and moreover the elongate direction of the ellipse is nearly parallel with the direction of the delivery port 4. Due to this, it is possible to supply molten steel more evenly to the two delivery ports 4 and hence make more even the delivery amount of molten steel from the left-and-right delivery ports 4.

Furthermore, the provision of the bore elliptic reduced portion 3 as a bore-reduced portion second closest to the delivery port provides an effect to reduce the vertical deviation of molten steel flow exiting through the delivery ports 4.

Figure 7:
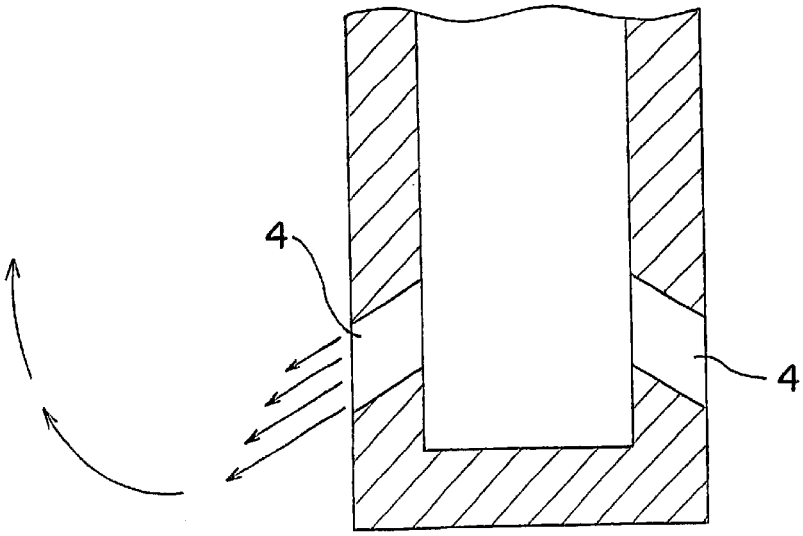
FIG. 7 is a view showing a state that molten steel flows out of the delivery port into a mold.

Generally, the flow of molten steel from the delivery port in the mold is faster in flow velocity as the lower end of the delivery port 4 is neared as shown in FIG. 7, thus providing a flow velocity distribution as shown by the length of the arrow. It is considered that, if the difference is great vertically in flow velocity, the flow of molten steel within the mold is disturbed to have a bad effect upon steel quality.

It can be considered that, if increasing the length of the bore elliptic reduced portion 3 closest to the delivery port 4 in FIG. 1, an effect is provided for preventing the flow deviation in a left-and-right direction of the molten steel to be led to the delivery port. On the other hand, however, because the portion smaller in sectional area is increased in length, the flow velocity of molten steel increases. The increase of flow velocity in the bore increases the vertical difference in flow velocity through the delivery port, raising a possibility of a bad effect upon steel quality.

Accordingly, by providing a bore elliptic reduced portion as a second closest bore reduced portion to the delivery port while sandwiching the bore enlarged portion, pressure loss is caused by the step to thereby decrease the flow velocity thus obtaining an effect that the overall velocity distribution nears an even state. Moreover, because the elongate direction of the ellipse is provided nearly parallel with the direction of the delivery port, the effect of preventing the molten-steel flow deviation in the left-and-right direction is enhanced greater than the case of one provision. In this case, because the bore enlarged portion is provided for the purpose of decreasing the flow velocity, the effect can be obtained if greater than the sectional area of the bore elliptic reduced portions on the both sides.

Meanwhile, it is rather preferred to make nearly circular in section the bore in a part other than the bore-reduced portion and moreover nearly circular the outer shape of the immersion nozzle, i.e. the basic structure is in a cylindrical form, from the view of practical application of the nozzle. The cylindrical form rather allows for manufacture at low cost with stable quality, having thermal stresses to be applied more even in use and hence increasing the life.

Accordingly, it is preferred from practical application, to make nearly circular the horizontal section of the bore in a part other than the bore-reduced portion and the horizontal section in the outer surface of the immersion nozzle.

Figure 8:
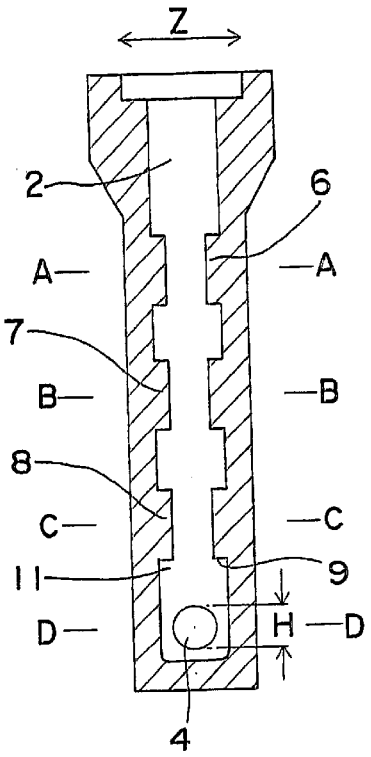
FIG. 8 is a vertical sectional view of an immersion nozzle of a fourth embodiment of the invention.
Figure 9:
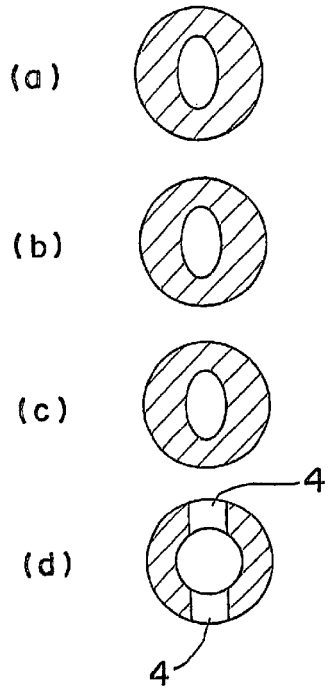
FIGS. 9 (*a*), (*b*), (*c*) and (*d*) are respectively an A—A section, a B—B section, a C—C section and a D—D section in FIG. 8, which are horizontal sectional views of bore reduced portions and a delivery port region.

A fourth embodiment of the invention is shown in FIG. 8 and FIGS. 9(*a*)–9(*d*).

The uppermost bore-reduced portion 6 has an ellipse having an elongate direction given rectangular in direction to a plate slide direction Z shown by the arrow in the FIG. 8. Namely, it is possible to obtain an effect to make, toward the bore center, the flow center of flow deviation resulting from the case of casting by throttling a plate bore.

In this case, despite that the effect can be obtained by a circular bore-reduced portion to a certain extent, the ellipse has an effect by far greater in the case of the same area. Namely, this is because the flow center readily nears the center of the bore due to the smaller distance in the shorter-side direction of an ellipse than a circular diameter. Moreover, because an elongate direction of the bore elliptic reduced portion above the delivery port is parallel with the delivery port, should the uppermost bore elliptic reduced portion be rectangular to the delivery port, flow-deviation effect can be obtained.

Figure 10:
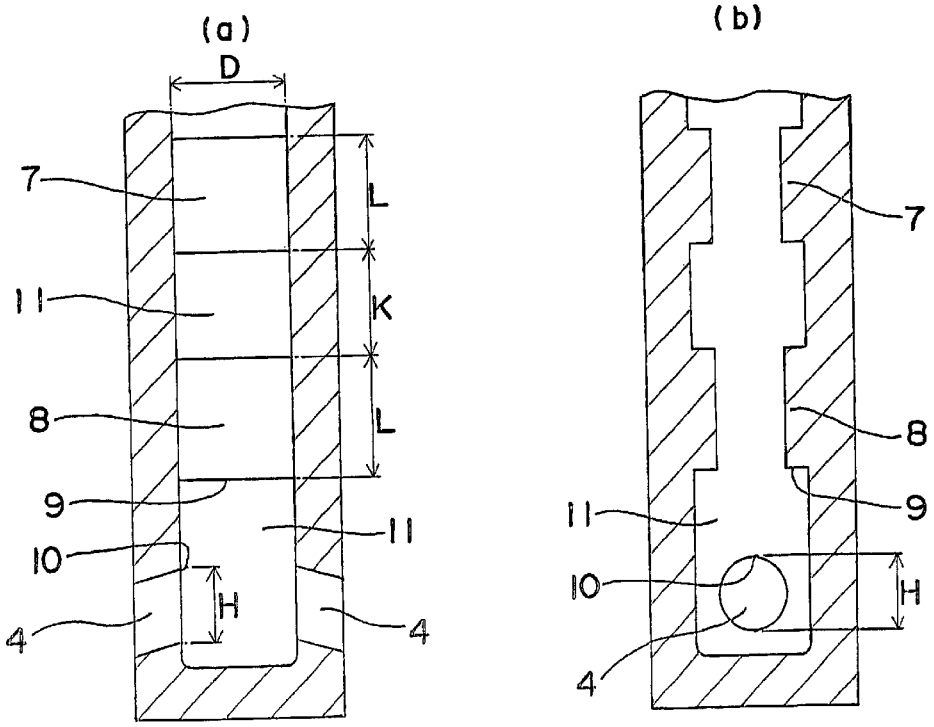
FIG. 10(*a*) is a vertical sectional view for explaining a relationship of location between the bore reduced portion and the delivery port of the immersion nozzle of FIG. 8, while FIG. 10(*b*) is a sectional view of FIG. 10 (*a*) rotated 90 degrees.

In FIGS. 10(*a*) and 10(*b*) for explaining the positional relationship between the bore-reduced portions and the delivery ports of an immersion nozzle, the bore elliptic reduced portion 8 closest to the delivery port 4 is provided at its lower end 9 in a range of 0.3H–2H of a delivery port height H from an upper end 10 of the delivery port 4 thereby obtaining a flow-deviation preventing effect. By providing a bore enlarged portion 11 between the bore-reduced portion and the delivery port 4, the molten-steel flow falling in the bore 2 causes a pressure loss thereby making possible to reduce the flow velocity. As explained in the above FIG. 7, the decrease in flow velocity makes possible to reduce the variation in flow velocity in the vertical direction of the delivery port. Consequently, the bore enlarged portion 11 referred to herein, if greater than the bore sectional area of the bore elliptic reduced portion 8 closest to the delivery port 4, can obtain that effect.

Also, if the spacing K between the bore elliptic reduced portion 8 closest to the delivery port 4 and the bore elliptic reduced portion 7 second closest to the delivery port 4 is given K=0.3D–2D provided that the bore diameter is D, the flow-deviation preventing effect can be obtained furthermore. This spacing is provided to reduce the flow velocity of molten steel. If the spacing is smaller than 0.3D, the flow-velocity reducing effect cannot be sufficiently obtained while, if the spacing exceeds 2D, the deviation flow rectifying effect of the molten-steel cannot be sufficiently obtained.

Also, the length L of the bore elliptic reduced portion, if within the range 0.5D–5D, obtains the flow-deviation preventing effect furthermore. If less than 0.5D, the rectifying effect is insufficient while, if exceeding 5D, flow velocity becomes too high.

Herein, the bore diameter D is given a diameter of the maximum in bore sectional area in the horizontal section of the bore.

In FIGS. 10(*a*) and 10(*b*) the bore diameter D is 90 mm, the length L of the second closest bore elliptic reduced portion 7 to the delivery port 4 is 150 mm, the length L of the closest bore elliptic reduced portion 8 to the delivery port 4 is 150 mm, the bore enlarged portion or spacing K between the two bore elliptic reduced portions 7, 8 is 100 mm, the distance between the delivery-port upper bore elliptic reduced portion 8 to the delivery port 4 is 50 mm, and the delivery port height H is 70 mm.

Figure 11:
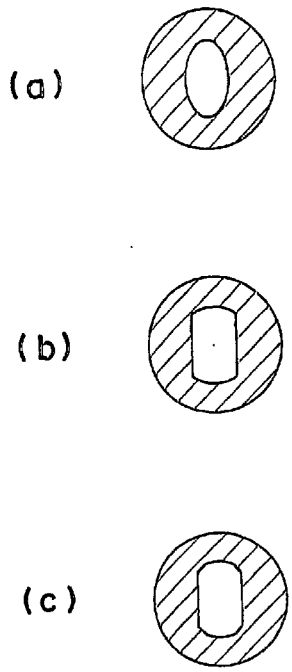
FIGS. 11(*a*), (*b*) and (*c*) is a sectional view showing another example of a bore reduced portion having a bore in an elliptic form-like in horizontal section as referred in the invention.

In the horizontal section as referred to in the invention, the bore elliptic reduced portion having an elliptic-formed bore includes, as shown in FIGS. 11(*a*)–11(*c*) an elliptic form in FIG. 11(*a*), a rectangular form in FIG. 11(*b*), and further a polygonal form in FIG. 11(*c*), in the elliptic form as referred in the invention.

The immersion nozzle of the invention prevents flow deviation through the opposed delivery ports in continuous casting with molten steel to equalize delivery flow from left and right whereby the molten-steel flow within the mold is stabilized to prevent the flow deviation within the mold thereby reducing the entrainment of powder, bubbles, etc. and contributing to homogeneous solidification to enable stable casting and quality improvement. Furthermore deposition of inclusions is reduced to the nozzle bore and delivery port.

Figure 12:
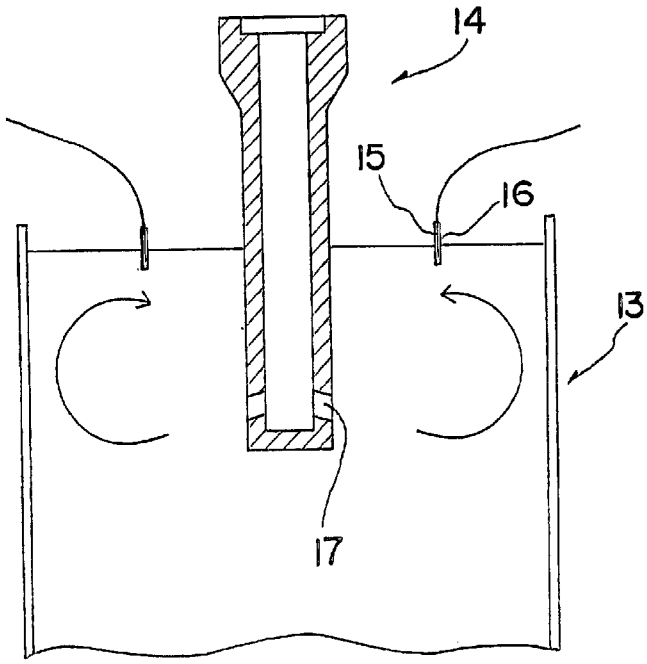
FIG. 12 is a schematic view of a test unit used in a water model test.

Hereunder, shown is a result that the immersion nozzles in various bore forms according to the invention fabricated with acryl to conduct water-model experiment as shown in FIG. 12 for observation of a flow-deviation state.

The test unit was an acryl-made water tank 13 assuming a mold and an acryl-made immersion nozzle 14 arranged therein wherein, while supplying constant water to the bore of the immersion nozzle, the same amount of water is discharged from the tank to maintain the water level constant at all times. In order to examine the degree of flow deviation, measurement was made on water velocity in the tank surface and the flow velocity of the water exiting the delivery port.

The velocity in the tank surface was measured by arranging the thin plastic plates 16 attached with a strain gauge 15 in the left and right at around the water surface to measure a strain amount thereof. The strain corresponds to the velocity of water flow as shown in the below formula so that a flow velocity can be calculated from a strain amount by the below formula.

$$V = A \cdot \sqrt{\varepsilon}$$

V: flow velocity

A: constant determined by plastic plate rigidity and sectional area

∈: strain amount

The water flow in the surface, as shown by the arrows, is an inversion flow to the water exiting through the delivery port 17. It is possible to know a degree of the flow deviation at the delivery port 17 from the difference between the inversion flows in the left and right. Furthermore, for water flow distribution in a vertical direction of the delivery port 17, flow velocity was measured by arranging Pitot tubes at three positions of upper, middle and lower in the delivery port 17.

Figure 13:
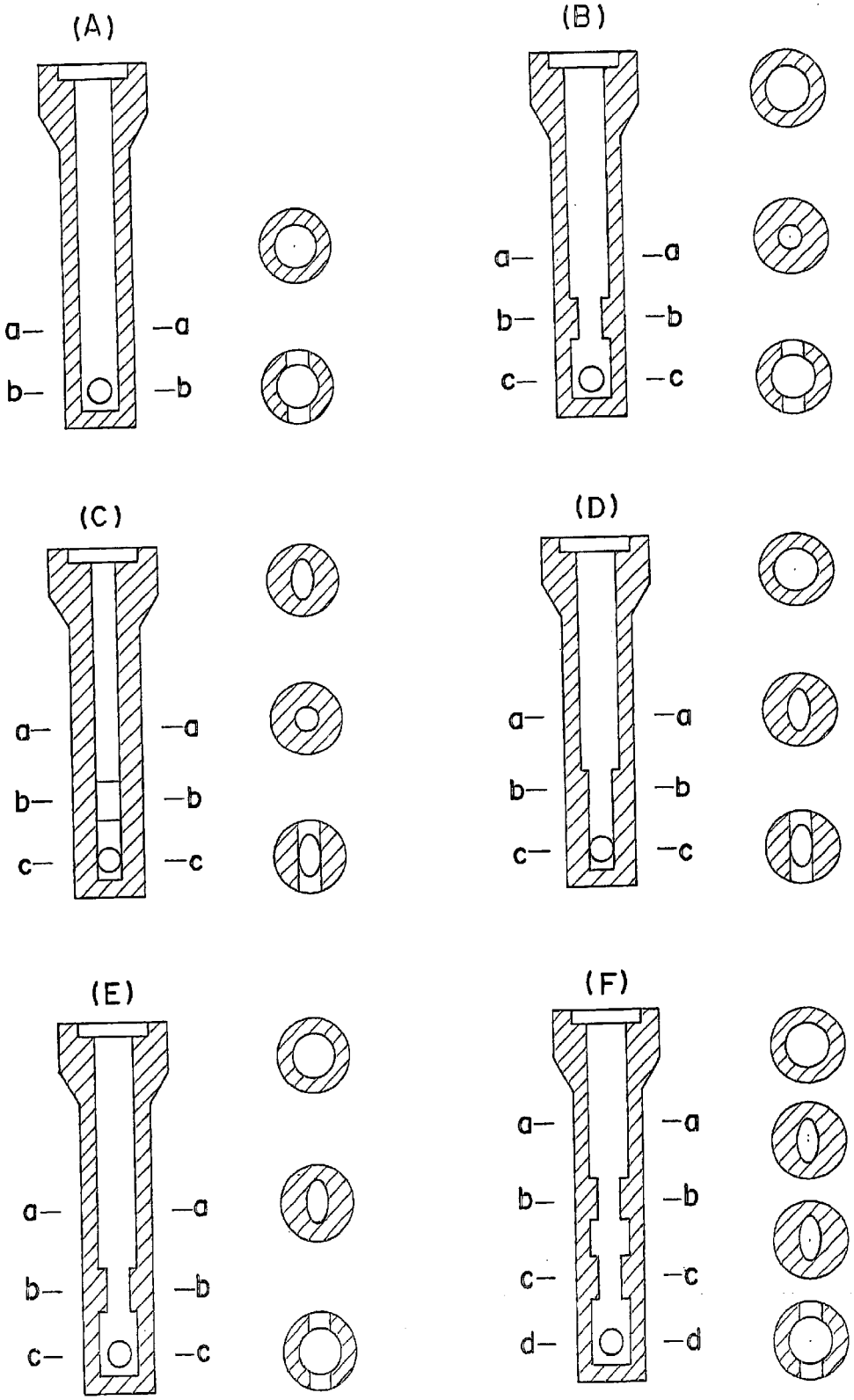
FIGS. 13 (A), (B), (C), (D), (E), and (F) are vertical sectional views of various immersion nozzles.

Table 1 shows a result of measurement of inversion flow with various immersion nozzles shown in FIG. 13. The evaluation of inversion flow is shown in B/S [$m^2$/min], with the flow velocity difference of water between the left and right taken as B [m/sec] and the water passage amount through the bore as S. The reason of indicating B/S is because inversion flow is nearly proportional to water passage amount.

The flow velocity was calculated from a mean value of strain amount of a test conducted for 30 minutes.

The water flow distribution at the delivery port, because nearly proportional to water passage amount similarly to inversion flow, is shown in Vt/s by taking the flow velocity at the delivery port as Vt [m/sec]. The immersion nozzle is made to have an overall length 900 mm, an inner diameter 70 mm and a delivery port diameter 70 mm, which is common to A–F of FIG. 13. The bore-reduced portion of a comparative example B has an area of 80% of the immersion-nozzle bore, a length of 70 mm and a distance from a lower end surface to a upper end of the delivery port of 50 mm. The bore-reduced portion of a comparative example C has an area of 80% of the immersion-nozzle bore, a length of 70 mm and a distance from a lower end surface to a upper end of the delivery port of 50 mm. The bore-reduced portion of a comparative example D has an area of 80% of the immersion-nozzle bore and a length of 300 mm. The bore-reduced portion of an embodiment E has an area of 80% of the immersion-nozzle bore, a length of 70 mm and a distance from a lower end surface to a upper end of the delivery port of 50 mm. The bore-reduced portion of an embodiment F has the closest one to the delivery port, having an area of 80% of the immersion-nozzle bore, a length of 70 mm and a distance gap from a lower end surface to a upper end of the delivery port of 50 mm, and the second closest one to the delivery port having an area of 80% of the immersion-nozzle bore, a length of 70 mm. In the embodiment F, the spacing between the two bore-reduced portions is 50 mm.

Although the embodiment E has only one bore elliptic reduced portion provided parallel with the delivery port, B/S is 0.12 that is about a half of the comparative example, thus obtaining a great flow deviation preventing effect. Furthermore, the embodiment F having two bore elliptic reduced portions provided parallel with the delivery port obtained flow deviation preventing effect considerably greater than the embodiment E, having B/S as low as 0.10. Furthermore, the difference in flow velocity distribution at the delivery port is sufficiently small.

The comparative example A, in the case of a straight form, has B/S of 0.50 thus being great in the extent of flow deviation. The comparative example B is circular in bore-reduced portion to have B/S of 0.34, which is considerably improved but has a significant flow deviation. The comparative example C is elliptic in the bore and circular in the bore-reduced portion. Because this is circular in the bore-reduced portion to collect the flow totally to a central region, distribution cannot be made equal to the left and right hence giving a difference in flow rate at between the left and right delivery ports. The comparative example D is elliptic in bore section at around the delivery port but small in sectional area, thus having a great difference in flow-velocity distribution at between the delivery ports.

TABLE 1

| | Comparative example | | | | Embodiment | |
|---|---|---|---|---|---|---|
| | A | B | C | D | E | F |
| Inversion flow B/S | 0.50 | 0.34 | 0.37 | 0.30 | 0.12 | 0.10 |
| Flow velocity at delivery port Vt/S | | | | | | |
| Upper | −0.3 | +0.1 | 0 | −0.4 | +0.2 | +0.2 |
| Middle | +0.6 | +0.7 | +0.5 | +0.7 | +0.9 | +0.8 |
| Small | +0.3 | +2.6 | +0.7 | +3.1 | +2.5 | +2.4 |

Figure 14:
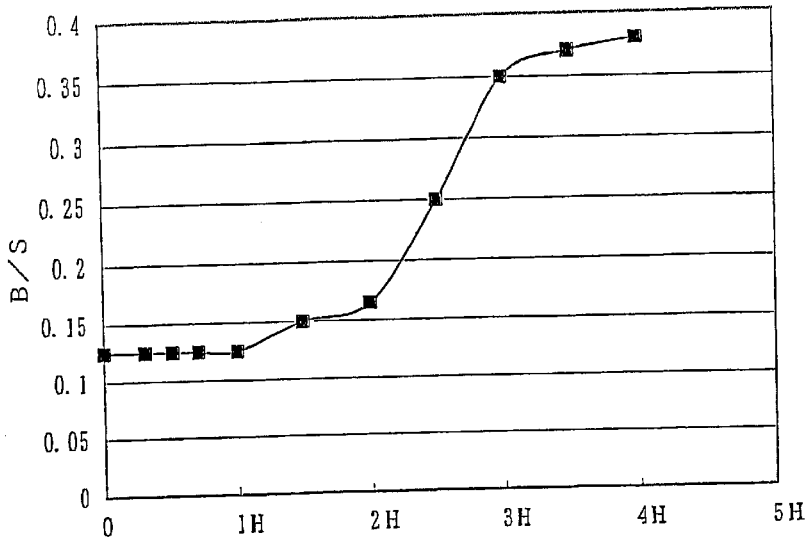
FIGS. 14(*a*) and (*b*) are graphs showing an effect, upon flow deviation, of the distance between the lower end surface of the bore reduced portion and the delivery-port upper end, and FIG. 14(*c*) is a cross section showing dimensional parameters.
Figure 14:
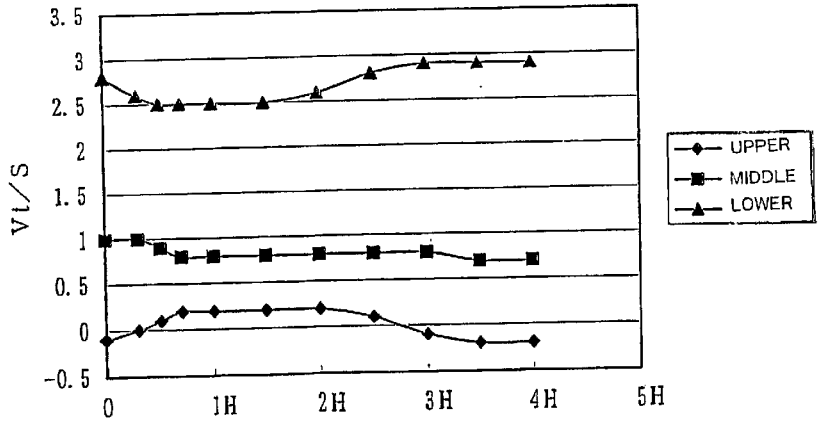
Figure 14:
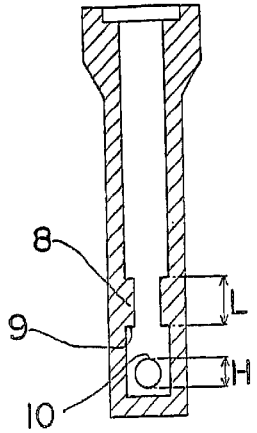

Next, shown in FIG. 14(*a*) is a result of a similar water model test conducted concerning the effect, on flow deviation, of a distance between the lower end surface 9 of the bore-reduced portion 8 and the delivery-port upper end 10. FIG. 14(*a*) shows a difference of the inverted flow, FIG. 14(*b*) a result of measurement on a flow velocity at the delivery port, and FIG. 14(*c*) a test-sample schematic view. The test sample is acryl, having a delivery port circular in section having a height H of 70 mm, a bore elliptic reduced portion having a length L of 70 mm, an immersion nozzle having an overall length of 900 mm, a bore elliptic reduced portion having an ellipse directed parallel with the delivery port, and an inner bore of other than the bore-reduced portion being circular.

From FIG. 14(*a*), as the distance between the lower end surface of the bore-reduced portion and the upper end of the delivery port increases, B/S increases to have an increased degree of flow deviation. As apparent from this figure, a conspicuous effect is exhibited at a distance of up to 2H but the effect is lessened at the greater distance than that.

Meanwhile, even if the distance decreases between the lower end surface of the bore-reduced portion and the upper end of the delivery port, B/S will not worsen but is difficult in obtaining a velocity lowering effect at the delivery port. Namely, as shown in FIG. 14(*b*), if the bore-reduced portion excessively nears the delivery port, the flow velocity at the delivery port increases and, particularly, the delivery-port lower end is influenced to have an increased flow velocity. This increases variation vertically in the delivery flow. This variation at upper and lower, if increased, causes a problem with powder entrainment due to inversion flow or reverse flow at the upper region in the delivery port. Accordingly, the distance between the lower end surface of the bore-reduced portion and the upper end of the delivery port is preferably 0.3H or greater.

Figure 15:
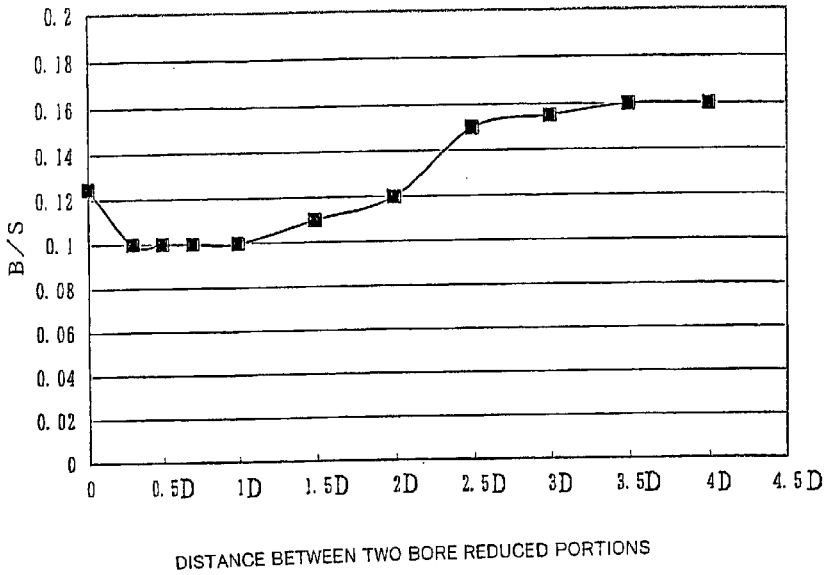
FIGS. 15(*a*) and (*b*) are graphs showing an effect, upon flow deviation, of the spacing between the bore-elliptic reduced portion closest to the delivery port and the bore elliptic reduced portion second closest to the delivery port, and FIG. 15(*c*) is a cross section showing dimensional parameters.
Figure 15:
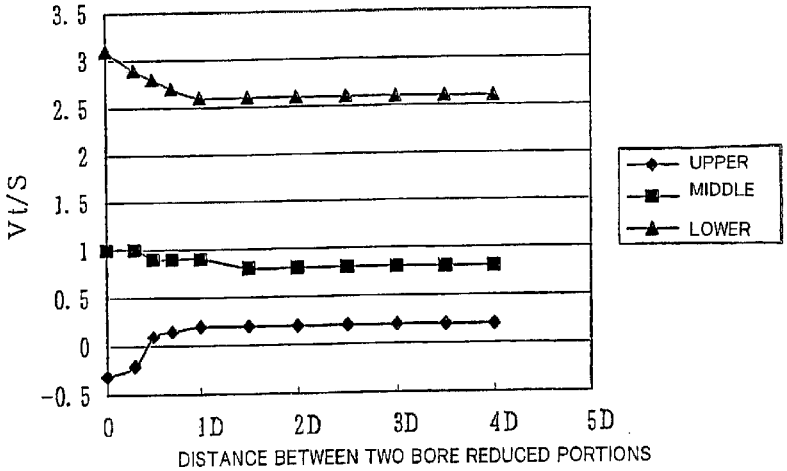
Figure 15:
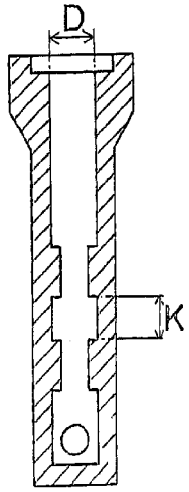

In FIGS. 15(*a*) and 15(*b*) there is shown a result of a similar water model test conducted concerning the effect, upon flow deviation, of the distance between the bore elliptic reduced portion closest to the delivery port and the bore elliptic reduced portion second closest to the delivery port. FIG. 15(*a*) shows a difference of the inverted flow velocity, FIG. 15(*b*) a result of measurement on a flow velocity at the delivery port, and FIG. 15(*c*) a test-sample schematic view. The test sample is [acryl make,] made having a delivery port circular in section having a height H of 70 mm, each bore elliptic reduced portion having a length L of 70 mm, an immersion nozzle having an overall length of 900 mm, a bore elliptic reduced portion having an ellipse directed parallel with the delivery port, and an inner bore of other than the bore-reduced portion being circular. The bore elliptic reduced portion closest to the delivery port is fixed 50 mm in distance between its lower end and the delivery-port upper end. By changing the position of the bore-reduced portion second closest to the delivery port, the spacing was changed between the two bore elliptic reduced portions.

From FIG. 15(*a*), as the distance between the two bore-reduced portions increases, B/S increases to have an increased degree of flow deviation. As apparent from this figure, a conspicuous effect is exhibited at a spacing of up to 2D, and the spacing between the two bore elliptic reduced portions is preferably 2D or smaller.

Meanwhile, when the spacing decreases between the two bore-reduced portions, B/S decreases to reduce the flow deviation at the left and right delivery ports. However, if the distance is excessively small, the flow velocity increases at the delivery port. Namely, as in FIG. 15(*b*), this increases variation vertically in the delivery flow. This variation, if increased, causes a problem with powder entrainment. Accordingly, the lower limit of the spacing is preferably 0.3H or greater between the bore elliptic reduced portion closest to the delivery port and the bore elliptic reduced portion second closest to the delivery port.

Figure 16:
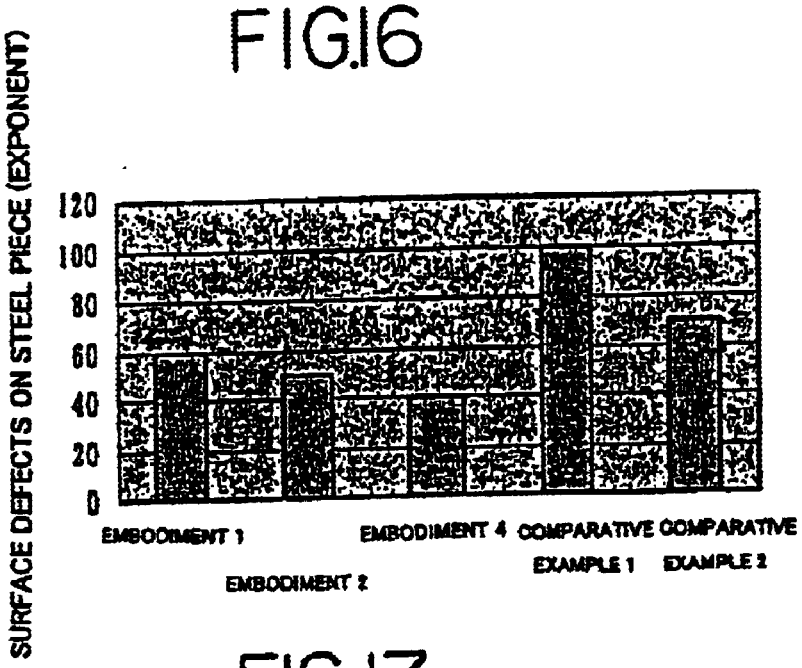
FIG. 16 is a graph showing results of examinations on steel piece surface defects in an actual castings using various kinds of immersion nozzles.
Figure 17:
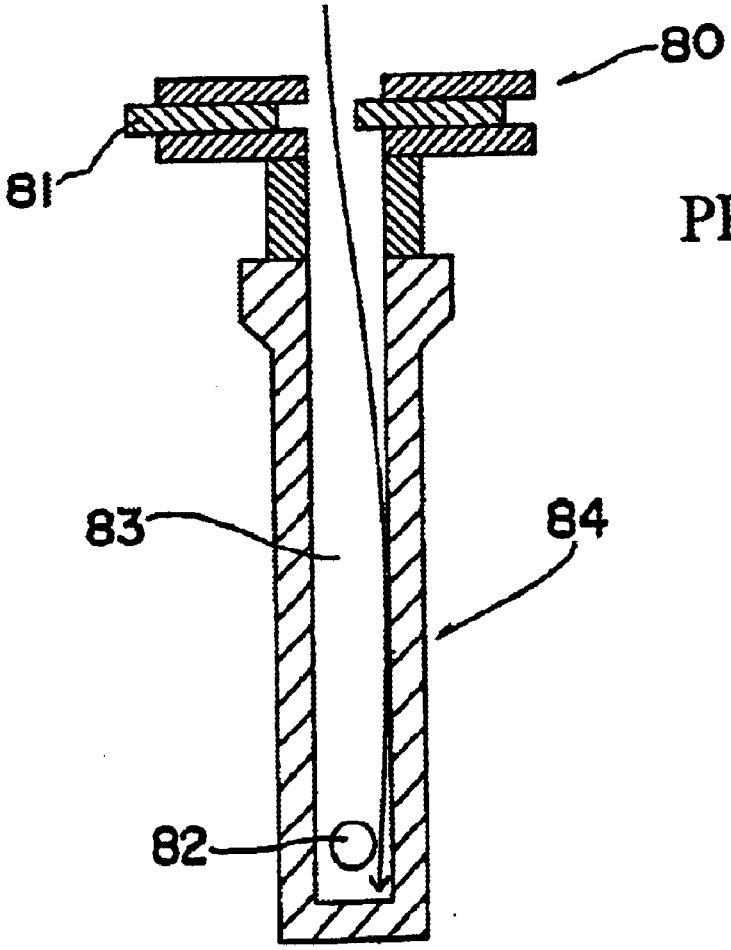
FIG. 17 is a vertical sectional view of a refractory component for controlling flow rate by sliding a middle plate of a sliding nozzle device comprising three plates.

FIG. 16 is a graph of results rounded off of the examinations on surface defects on steel pieces that used, in casting 600-ton molten-steel in an actual operation with, the immersion nozzle of the first embodiment of FIG. 1, the immersion nozzle of the second embodiment of FIG. 3, the immersion nozzle of the fourth embodiment of FIG. 8, the immersion nozzle having a straight bore of FIG. 13(*a*) as the comparative example 1 or that circular in bore-hosho portion of FIG. 13(*b*) as the comparative example 2.

The number of defects per square meters on a steel piece in the case of using an immersion nozzle with a straight bore was exponentially represented 100, to exponentially express the cases. In any case of the embodiments, there were less surface defects than the comparative example 2 conventionally circular in bore-reduced portion, thus exhibiting a preferred result of quality.

The present invention is used in an immersion nozzle for pouring molten steel into a mold during continuous casting of steel.

What is claimed is:

1. In an immersion nozzle having opposite two delivery ports and one or more bore reduced portions in a bore above the delivery port wherein the bore in a portion other than the reduced portion is circular in section, a flow deviation preventing immersion nozzle characterized in that: the bore reduced portion closest to the delivery port assumes an elliptic form in horizontal section of the bore reduced portion, an elongate direction of the ellipse is nearly parallel with an opposing direction of the delivery ports and the bore reduced portion lower end is provided to position in a range of 0.3H–2H of a delivery-port height H from a delivery-port upper end.

2. In an immersion nozzle having opposite two delivery ports and two or more bore reduced portions in a bore above the delivery port wherein the bore in a portion other than the reduced portion is circular in section, a flow deviation preventing immersion nozzle characterized in that: the bore reduced portion closest to the delivery port and the bore reduced portion second closest to the delivery port both assume an elliptic form in horizontal section of the bore reduced portion and an elongate direction of the ellipse is nearly parallel with an opposing direction of the delivery ports.

3. A deviated-flow preventing immersion nozzle according to claim 2, wherein the lower end of the bore reduced portion closest to the delivery port is provided to position in a range of 0.3H–2H of a delivery-port height H from a delivery-port upper end.

4. A deviated-flow preventing immersion nozzle according to claim 1, claim 2, or claim 3, wherein a spacing between the bore reduced portion second closest to the delivery port and the below bore reduced portion closest to the delivery port is provided to position in a range of 0.3D–2D of an inner diameter D of the bore.

5. A flow deviation preventing immersion nozzle according to claim 1, claim 2, or claim 3, wherein the bore reduced portion of the uppermost bore reduced portion is in an elliptic form in horizontal section and an elongate direction of the ellipse is in a perpendicular direction to a sliding direction of a plate brick of a sliding nozzle device.

* * * * *